US008117016B2

(12) United States Patent
Halabe et al.

(10) Patent No.: US 8,117,016 B2
(45) Date of Patent: Feb. 14, 2012

(54) SYSTEM AND METHOD FOR OILFIELD PRODUCTION OPERATIONS

(75) Inventors: Vijaya Halabe, Abingdon (GB); Richard Torrens, Whitchurch (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 914 days.

(21) Appl. No.: 12/105,104

(22) Filed: Apr. 17, 2008

(65) Prior Publication Data

US 2008/0262802 A1 Oct. 23, 2008

Related U.S. Application Data

(60) Provisional application No. 60/925,425, filed on Apr. 19, 2007.

(51) Int. Cl.
*G06G 7/48* (2006.01)

(52) U.S. Cl. ..... 703/6

(58) Field of Classification Search ..... 703/6
See application file for complete search history.

(56) References Cited

U.S. PATENT DOCUMENTS

| | | | | |
|---|---|---|---|---|
| 4,794,534 | A | 12/1988 | Millheim | |
| 5,992,519 | A | 11/1999 | Ramakrishnan et al. | |
| 6,313,837 | B1 | 11/2001 | Assa et al. | |
| 6,873,267 | B1 | 3/2005 | Tubel et al. | |
| 6,980,940 | B1 | 12/2005 | Gurpinar et al. | |
| 7,079,952 | B2 * | 7/2006 | Thomas et al. | 702/13 |
| 2003/0132934 | A1 | 7/2003 | Fremming | |
| 2003/0216897 | A1 | 11/2003 | Endres et al. | |
| 2004/0220846 | A1 | 11/2004 | Cullick et al. | |
| 2005/0149307 | A1 | 7/2005 | Gurpinar et al. | |
| 2006/0047489 | A1 | 3/2006 | Scheidt et al. | |
| 2006/0197759 | A1 | 9/2006 | Fremming | |
| 2007/0112547 | A1 | 5/2007 | Ghorayeb et al. | |

FOREIGN PATENT DOCUMENTS

| | | | |
|---|---|---|---|
| CA | 2636428 | A1 | 7/2007 |
| WO | 99/64896 | A1 | 12/1999 |
| WO | 9964896 | | 12/1999 |
| WO | 2004/049216 | A1 | 6/2004 |
| WO | 2004049216 | | 6/2004 |

OTHER PUBLICATIONS

Ridha B.C. Gharbi et al., "An expert system for selecting and designing EOR processes", 2000, Journal of Petroleum Science and Engineering, vol. 27, pp. 33-47.*

(Continued)

*Primary Examiner* — Paul Rodriguez
*Assistant Examiner* — Russ Guill

(57) ABSTRACT

The invention relates to a method of performing production operations. The method includes identifying a plurality of simulators from a group consisting of a wellsite simulator for modeling at least a portion of the wellsite of the oilfield and a non-wellsite simulator for modeling at least a portion of a non-wellsite portion of the oilfield, defining a first strategy template comprising a first condition defined based on a first variable of the plurality of simulators and a first action defined based on a control parameter of the plurality of simulators, wherein execution of the first action during simulation is determined based on the first condition in view of a logical relationship, developing a first strategy for managing the plurality of simulators during simulation, wherein the first strategy is developed using the first strategy template, and selectively simulating the operations of the oilfield using the plurality of simulators based on the first strategy.

28 Claims, 7 Drawing Sheets

OTHER PUBLICATIONS

Ridha Gharbi, "Application of an expert system to optimize reservoir performance", 2005, Journal of Petroleum Science and Engineering, vol. 49, pp. 261-273.*
Guadalupe I. Janoski et al., "Alternate methods in reservoir simulation", 2001, Lecture Notes in Computer Science, vol. 2074, Springer-Verlag, pp. 253-262.*
Sameer A. Khan et al., "An expert system for miscible gasflooding", 1993, SPE Computer Applications, vol. 5, No. 1, pp. 11-17.*
Tuncer I. Oren, "Artificial intelligence in simulation", 1994, Annals of Operation research, vol. 53, pp. 287-319.*
K. Kawamura et al., "Ness: a coupled simulation expert system", 1986, Proceedings of the ACM SIGART international symposium on methodologies for intelligent systems, pp. 28-39.*
Gokhan Hepguler et al., "Integration of a field surface and production network with a reservoir simulator", 1997, Society of Petroleum Engineers, SPE 38937, pp. 88-93.*
V.J. Zapata et al., "Advances in tightly coupled reservoir/wellbore/surface-network simulation", 2001, Society of Petroleum Engineers, SPE 71120, pp. 114-120.*
C.C. Barroux et al., "Linking reservoir and surface simulators: how to improve the coupled solutions", 2000, Society of Petroleum Engineers, SPE 65159, pp. 1-14.*
E. Hayder et al., "Production optimization through coupled facility/reservoir simulation", 2006, Society of Petroleum Engineers, SPE 100027, pp. 1-6.*
James R. Spiegel et al., "A simulation engine-combining an expert system with a simulation language", 1988, Telematics and Informatics, vol. 5, No. 3, pp. 289-296.*
Ghorayeb, K. et al., "Field Planning Using Integrated Surface/Subsurface Modeling", SPE International, 14th SPE Middle East Oil & Gas Show and Conference, Mar. 12-15, 2005, pp. 1-9, SPE 92381, Bahrain.
International Search Report from International Application No. PCT/US2008/060907, dated Aug. 29, 2008, 2 pages.
K. Ghorayeb SPE, J. Holmes, SPE, and R. Torrens, "Field Planning Integrated Surface/Subsurface Modeling", Society of Petroleum Engineers Inc., Copyright 2005, (9 Pages).

* cited by examiner

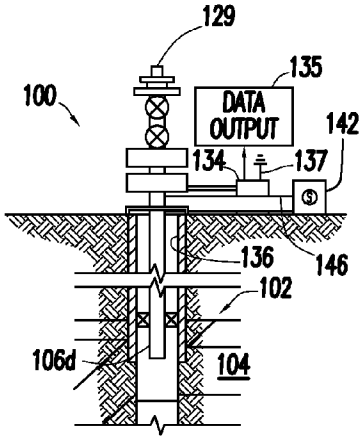
FIG. 1A
FIG. 1B
FIG. 1C
FIG. 1D
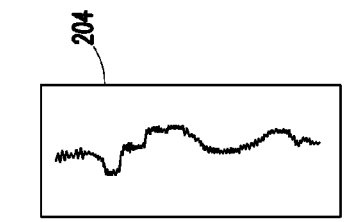
FIG. 2A
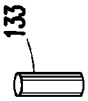
FIG. 2B
FIG. 2C
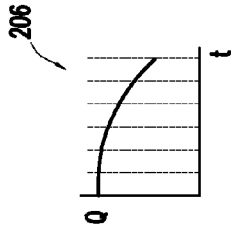
FIG. 2D

SYSTEM AND METHOD FOR OILFIELD PRODUCTION OPERATIONS

CROSS-REFERENCE TO RELATED APPLICATIONS

This application claims benefit under 35 U.S.C. §119(e) of filing date of U.S. Provisional Application Ser. No. 60/925,425 entitled "SYSTEM AND METHOD FOR OILFIELD PRODUCTION OPERATIONS," filed on Apr. 19, 2007.

BACKGROUND OF THE INVENTION

1. Field of the Invention

The present invention relates to techniques for performing oilfield operations relating to subterranean formations having reservoirs therein. More particularly, the invention relates to techniques for performing oilfield operations involving an analysis of oilfield conditions, such as geoscience, reservoir, wellbore, surface network, and production facilities, and their impact on such operations.

2. Background of the Related Art

Oilfield operations, such as surveying, drilling, wireline testing, completions and production, are typically performed to locate and gather valuable downhole fluids. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing. Throughout this document, the term "wellbore" is used interchangeably with the term "borehole."

After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipments may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources.

Such formation data may be static or dynamic. Static data relates to formation structure and geological stratigraphy that defines the geological structure of the subterranean formation. Dynamic data relates to fluids flowing through the geologic structures of the subterranean formation. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples are used to take physical specimens of the formation at various depths as shown in FIG. 1B. Well logging involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure and composition may be monitored. These parameters may be used to determine various characteristics of the subterranean formation.

Sensors may be positioned about the oilfield to collect data relating to various oilfield operations. For example, sensors in the wellbore may monitor fluid composition, sensors located along the flow path may monitor flow rates and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other configurations. Often this information is used to determine when to drill new wells, re-complete existing wells or alter wellbore production.

Data from one or more wellbores may be analyzed to plan or predict various outcomes at a given wellbore. In some cases, the data from neighboring wellbores, or wellbores with similar conditions or equipment is used to predict how a well will perform. There are usually a large number of variables and large quantities of data to consider in analyzing wellbore operations. It is, therefore, often useful to model the behavior of the oilfield operation to determine the desired course of action. During the ongoing operations, the operating conditions may need adjustment as conditions change and new information is received.

Techniques have been developed to model the behavior of geological structures, downhole reservoirs, wellbores, surface facilities as well as other portions of the oilfield operation. Examples of modeling techniques are shown in Patent/Application Nos. U.S. Pat. No. 5,992,519, WO2004/049216, WO1999/064896, U.S. Pat. No. 6,313,837, US2003/0216897, US2003/0132934, US2005/0149307 and US2006/0197759.

Typically, simulators are designed to model specific behavior of discrete portions of the wellbore operation. Due to the complexity of the oilfield operation, most simulators are capable of only evaluating a specific segment of the overall production system, such as simulation of the reservoir. Simulations of portions of the wellsite operation, such as reservoir simulation, are usually considered and used individually.

A change in any segment of the production system, however, often has cascading effects on the upstream and downstream segments of the production system. For example, restrictions in the surface network can reduce productivity of the reservoir. Separate simulations typically fail to consider the data or outputs of other simulators, and fail to consider these cascading effects.

Recent attempts have been made to consider a broader range of data in oilfield operations. For example, U.S. Pat. No. 6,980,940 to Gurpinar discloses integrated reservoir optimization involving the assimilation of diverse data to optimize overall performance of a reservoir. In another example, WO2004/049216 to Ghorayeb discloses an integrated modeling solution for coupling multiple reservoir simulations and surface facility networks. Other examples of such recent attempts are disclosed in U.S. Patent/Application Nos. U.S. Pat. No. 5,992,519, US2004/0220846 and U.S. Ser. No. 10/586,283, as well as a paper entitled "Field Planning Using Integrated Surface/Subsurface Modeling," K. Ghorayeb et al., SPE92381, 14$^{th}$ Society of Petroleum Engineers Middle East Oil & Gas Show and Conference, Barrain, Mar. 12-15, 2005.

Despite the development and advancement of various aspects of analyzing oilfield operations, e.g., wellbore modeling and/or simulation techniques in discrete oilfield operations, there remains a need to provide techniques capable of performing a complex analysis of oilfield operations based on a wide variety of parameters affecting such operations. It is desirable that such a complex analysis provide an integrated view of geological, geophysical, reservoir engineering, and production engineering aspects of the oilfield. It is further desirable that such techniques consider other factors affecting other aspects of the oilfield operation, such as economics, drilling, production, and other factors. Such a system would preferably consider a wider variety and/or quantity of data affecting the oilfield, and perform an efficient analysis thereof.

Preferably, the provided techniques are capable of one of more of the following, among others: generating static models based on any known measurements, selectively modeling based on a variety of inputs, selectively simulating according to dynamic inputs, adjusting models based on probabilities, selectively linking models of a variety of functions (i.e., economic risk and viability), selectively performing feedback loops throughout the process, selectively storing and/or replaying various portions of the process, selectively displaying and/or visualizing outputs, and selectively performing desired modeling (i.e., uncertainty modeling), workflow knowledge capture, scenario planning and testing, reserves reporting with associated audit trail reporting, etc., selectively modeling oilfield operations based on more than one simulator, selectively merging data and/or outputs of more than one simulator, selectively merging data and/or outputs of simulators of one or more wellsites and/or oilfields, selectively linking a wide variety of simulators of like and/or different configurations, selectively linking simulators having similar and/or different applications and/or data models, selectively linking simulators of different members of an asset team of an oilfield, and providing coupling mechanisms capable of selectively linking simulators in a desired configuration.

Preferably, the provided technique, e.g., the coupling mechanism selectively linking simulators, provides a framework to build complex strategies from atomic field management operations. These strategies are rules for monitoring and modifying simulation models within the integrated asset model involving a reservoir model, a network model, a process model, an economics model, and the like. Preferably, these strategies can be built in a hierarchical manner within the provided framework.

SUMMARY OF INVENTION

In general, in one aspect, the invention relates to a method and system of performing production operations of an oilfield having at least one process facility and at least one wellsite operatively connected thereto, each at least one wellsite having a wellbore penetrating a subterranean formation for extracting fluid from an underground reservoir therein. The method includes identifying a plurality of simulators from a group consisting of a wellsite simulator for modeling at least a portion of the wellsite of the oilfield and a non-website simulator for modeling at least a portion of a non-wellsite portion of the oilfield, defining a first strategy template comprising a first condition defined based on a first variable of the plurality of simulators and a first action defined based on a control parameter of the plurality of simulators, wherein execution of the first action during simulation is determined based on the first condition in view of a logical relationship, developing a first strategy for managing the plurality of simulators during simulation, wherein the first strategy is developed using the first strategy template, and selectively simulating the operations of the oilfield using the plurality of simulators based on the first strategy.

In general, in one aspect, the invention relates to a computer readable medium, embodying instructions executable by the computer to perform method steps for performing production of an oilfield having at least one process facilities and at least one wellsite operatively connected thereto, each at least one wellsite having a wellbore penetrating a subterranean formation for extracting fluid from an underground reservoir therein. The instructions include functionality to identify a plurality of simulators from a group consisting of a wellsite simulator for modeling at least a portion of the wellsite of the oilfield and a non-wellsite simulator for modeling at least a portion of a non-wellsite portion of the oilfield, define a first strategy template comprising a first condition defined based on a first variable of the plurality of simulators and a first action defined based on a control parameter of the plurality of simulators, wherein execution of the first action during simulation is determined based on the first condition in view of a logical relationship, develop a first strategy for managing the plurality of simulators during simulation, wherein the first strategy is developed using the first strategy template, and selectively simulating the operations of the oilfield using the plurality of simulators based on the first strategy.

In general, in one aspect, the invention relates to an oilfield simulator for performing production of an oilfield having at least one process facilities and at least one wellsite operatively connected thereto, each at least one wellsite having a wellbore penetrating a subterranean formation for extracting fluid from an underground reservoir therein. The oilfield simulator includes a plurality of simulators from a group consisting of a wellsite simulator for modeling at least a portion of the wellsite of the oilfield and a non-wellsite simulator for modeling at least a portion of a non-wellsite portion of the oilfield, an strategy template comprising a first condition defined based on a first variable of the plurality of simulators and a first action defined based on a control parameter of the plurality of simulators, wherein execution of the first action during simulation is determined based on the first condition in view of a logical relationship, and a surface unit at the oilfield, wherein the surface unit develops a first strategy for managing the plurality of simulators during simulation, the first strategy being developed using the first strategy template, wherein the operations of the oilfield are selectively simulated based on the first strategy using the plurality of simulators.

In general, in one aspect, the invention relates to a computer program product, embodying instructions executable by the computer to perform method steps for performing production of an oilfield having at least one process facilities and at least one wellsite operatively connected thereto, each at least one wellsite having a wellbore penetrating a subterranean formation for extracting fluid from an underground reservoir therein. The instructions includes functionality to identify a plurality of simulators from a group consisting of a wellsite simulator for modeling at least a portion of the wellsite of the oilfield and a non-wellsite simulator for modeling at least a portion of a non-wellsite portion of the oilfield, define a first strategy template comprising a first condition defined based on a first variable of the plurality of simulators and a first action defined based on a control parameter of the plurality of simulators, wherein execution of the first action during simulation is determined based on the first condition in view of a logical relationship, develop a first strategy for managing the plurality of simulators during simulation, wherein the first strategy is developed using the first strategy template, and selectively simulating the operations of the oilfield using the plurality of simulators based on the first strategy.

Other aspects and advantages of the invention will be apparent from the following description and the appended claims.

BRIEF DESCRIPTION OF DRAWINGS

FIGS. 1A-1D depict a schematic view of an oilfield having subterranean structures containing reservoirs therein, various oilfield operations being performed on the oilfield.

FIGS. 2A-2D are graphical depictions of data collected by the tools of FIGS. 1A-D, respectively.

DETAILED DESCRIPTION

Figure 3:
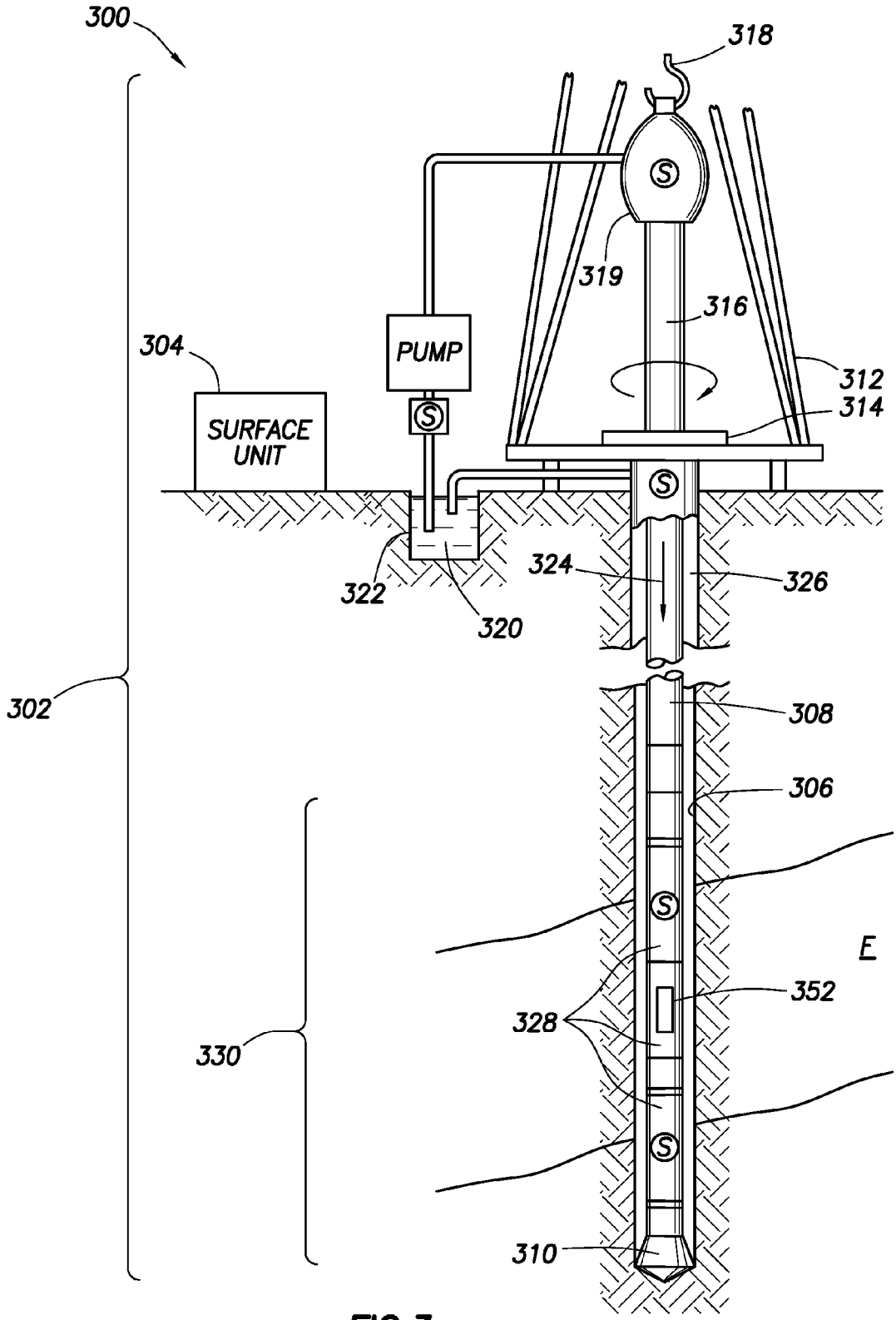
FIG. 3 is a schematic view, partially in cross-section of a drilling operation of an oilfield.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. In other instances, well-known features have not been described in detail to avoid obscuring the invention.

The present invention involves applications generated for the oil and gas industry. FIGS. 1A-1D illustrate an exemplary oilfield (100) with subterranean structures and geological structures therein. More specifically, FIGS. 1A-1D depict schematic views of an oilfield (100) having subterranean structures (102) containing a reservoir (104) therein and depicting various oilfield operations being performed on the oilfield. Various measurements of the subterranean formation are taken by different tools at the same location. These measurements may be used to generate information about the formation and/or the geological structures and/or fluids contained therein.

FIG. 1A depicts a survey operation being performed by a seismic truck (106*a*) to measure properties of the subterranean formation. The survey operation is a seismic survey operation for producing sound vibrations. In FIG. 1A, an acoustic source (110) produces sound vibrations (112) that reflect off a plurality of horizons (114) in an earth formation (116). The sound vibration(s) (112) is (are) received in by sensors, such as geophone-receivers (118), situated on the earth's surface, and the geophones-receivers (118) produce electrical output signals, referred to as data received (120) in FIG. 1.

The received sound vibration(s) (112) are representative of different parameters (such as amplitude and/or frequency). The data received (120) is provided as input data to a computer (122*a*) of the seismic truck (106*a*), and responsive to the input data, the recording truck computer (122*a*) generates a seismic data output record (124). The seismic data may be further processed, as desired, for example by data reduction.

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool via a flow line (132) for circulating drilling mud through the drilling tool and back to the surface. The drilling tool is advanced into the formation to reach the reservoir (104). The drilling tool is preferably adapted for measuring downhole properties. The logging while drilling tool may also be adapted for taking a core sample (133) as shown, or removed so that a core sample (133) may be taken using another tool.

A surface unit (134) is used to communicate with the drilling tool and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield. The surface unit (134) collects data output (135) generated during the drilling operation. Such data output (135) may be stored on a computer readable medium (compact disc (CD), tape drive, hard disk, flash memory, or other suitable storage medium). Further, data output (135) may be stored on a computer program product that is stored, copied, and/or distributed, as necessary. Computer facilities, such as those of the surface unit, may be positioned at various locations about the oilfield and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions, measured depth, azimuth, inclination and other parameters of the oilfield operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting oilfield operations of the current and/or other wellbores.

Data outputs from the various sensors (S) positioned about the oilfield may be processed for use. The data may be may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, and/or reservoir engineering simulations. The reservoir, wellbore, surface, and/or process data may be used to perform reservoir, wellbore, or other production simulations. The data outputs (135) from the oilfield operation may be generated directly from the sensors (S), or after some preprocessing or modeling. These data outputs (135) may act as inputs for further analysis.

The data is collected and stored at the surface unit (134). One or more surface units may be located at the oilfield, or linked remotely thereto. The surface unit (134) may be a single unit, or a complex network of units used to perform the necessary data management functions throughout the oilfield. The surface unit (134) may be a manual or automatic system. The surface unit (134) may be operated and/or adjusted by a user.

The surface unit (134) may be provided with a transceiver (137) to allow communications between the surface unit (134) and various portions of the oilfield and/or other locations. The surface unit (134) may also be provided with or functionally linked to a controller for actuating mechanisms at the oilfield. The surface unit (134) may then send command signals to the oilfield in response to data received. The surface unit (134) may receive commands via the transceiver (137) or may itself execute commands to the controller. A processor may be provided to analyze the data (locally or remotely) and make the decisions to actuate the controller. In this manner, the oilfield may be selectively adjusted based on the data collected. These adjustments may be made automatically based on computer protocol, or manually by an operator. In some cases, well plans and/or well placement may be adjusted to select optimum operating conditions, or to avoid problems.

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (144) that provides electrical signals to the surrounding subterranean formations (102).

The wireline tool (106*c*) may be operatively linked to, for example, the geophone-receivers (118) stored in the computer (122*a*) of the seismic recording truck (106*a*) of FIG. 1A. The wireline tool (106*c*) may also provide data to the surface unit (134). As shown data output (135) is generated by the wireline tool (106*c*) and collected at the surface. The wireline tool (106*c*) may be positioned at various depths in the wellbore (136) to provide a survey of the subterranean formation (102).

FIG. 1D depicts a production operation being performed by a production tool (106*d*) deployed from a production unit or Christmas tree (129) and into the completed wellbore (136) of FIG. 1C for drawing fluid from the downhole reservoirs into the surface facilities (142). Fluid flows from reservoir (104) through perforations in the casing (not shown) and into the production tool (106*d*) in the wellbore (136) and to the surface facilities (142) via a gathering network (146).

Sensors (S), such as gauges, may be positioned about the oilfield to collect data relating to various oilfield operations as described previously. As shown, the sensor (S) may be positioned in the production tool (106*d*) or associated equipment, such as the Christmas tree, gathering network, surface facilities and/or the production facility, to measure fluid parameters, such as fluid composition, flow rates, pressures, temperatures, and/or other parameters of the production operation.

While only simplified wellsite configurations are shown, it will be appreciated that the oilfield may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

During the production process, data output (135) may be collected from various sensors (S) and passed to the surface unit (134) and/or processing facilities. This data may be, for example, reservoir data, wellbore data, surface data, and/or process data.

Throughout the oilfield operations depicted in FIGS. 1A-D, there are numerous business considerations. For example, the equipment used in each of these Figures has various costs and/or risks associated therewith. At least some of the data collected at the oilfield relates to business considerations, such as value and risk. This business data may include, for example, production costs, rig time, storage fees, price of oil/gas, weather considerations, political stability, tax rates, equipment availability, geological environment, and other factors that affect the cost of performing the oilfield operations or potential liabilities relating thereto. Decisions may be made and strategic business plans developed to alleviate potential costs and risks. For example, an oilfield plan may be based on these business considerations. Such an oilfield plan may, for example, determine the location of the rig, as well as the depth, number of wells, duration of operation and other factors that will affect the costs and risks associated with the oilfield operation.

While FIGS. 1A-1D depicts monitoring tools used to measure properties of an oilfield, it will be appreciated that the tools may be used in connection with non-oilfield operations, such as mines, aquifers or other subterranean facilities. In addition, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors (S) may be located at various positions along the subterranean formation and/or the monitoring tools to collect and/or monitor the desired data. Other sources of data may also be provided from offsite locations.

The oilfield configuration of FIGS. 1A-1D is not intended to limit the scope of the invention. Part, or all, of the oilfield may be on land and/or sea. In addition, while a single oilfield measured at a single location is depicted, the present invention may be utilized with any combination of one or more oilfields, one or more processing facilities, and one or more wellsites.

FIGS. 2A-D are graphical depictions of data collected by the tools of FIGS. 1A-D, respectively. FIG. 2A depicts a seismic trace (202) of the subterranean formation of FIG. 1A taken by survey tool (106*a*). The seismic trace measures the two-way response over a period of time. FIG. 2B depicts a core sample (133) taken by the logging tool (106*b*). The core test typically provides a graph of the density, resistivity, or other physical property of the core sample over the length of the core. FIG. 2C depicts a well log (204) of the subterranean formation of FIG. 1C taken by the wireline tool (106*c*). The wireline log typically provides a resistivity measurement of the formation at various depts. FIG. 2D depicts a production decline curve (206) of fluid flowing through the subterranean formation of FIG. 1D taken by the production tool (106*d*). The production decline curve typically provides the production rate (Q) as a function of time (t).

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

The models may be used to create an earth model defining the subsurface conditions. This earth model predicts the structure and its behavior as oilfield operations occur. As new information is gathered, part or all of the earth model may need adjustment.

FIG. 3 is a schematic view of a wellsite (300) depicting a drilling operation, such as the drilling operation of FIG. 1B, of an oilfield in detail. The wellsite system (300) includes a drilling system (302) and a surface unit (304). In the illustrated embodiment, a borehole (306) is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

The drilling system (302) includes a drill string (308) suspended within the borehole (306) with a drill bit (310) at its lower end. The drilling system (302) also includes the land-based platform and derrick assembly (312) positioned over the borehole (306) penetrating a subsurface formation (F). The assembly (312) includes a rotary table (314), kelly (316), hook (318), and rotary swivel (319). The drill string (308) is rotated by the rotary table (314), energized by means not shown, which engages the kelly (316) at the upper end of the drill string. The drill string (308) is suspended from hook (318), attached to a traveling block (also not shown), through the kelly (316) and a rotary swivel (319) which permits rotation of the drill string relative to the hook.

The drilling system (302) further includes drilling fluid or mud (320) stored in a pit (322) formed at the well site. A pump delivers the drilling fluid (320) to the interior of the drill string (308) via a port in the swivel (319), inducing the drilling fluid to flow downwardly through the drill string (308) as indicated by the directional arrow (324). The drilling fluid exits the drill string (308) via ports in the drill bit (310), and then circulates upwardly through the region between the outside of the drill string and the wall of the borehole, called the annulus (326). In this manner, the drilling fluid lubricates the drill bit (310) and carries formation cuttings up to the surface as it is returned to the pit (322) for recirculation.

The drill string (308) further includes a bottom hole assembly (BHA), generally referred to as (330), near the drill bit (310) (in other words, within several drill collar lengths from the drill bit). The bottom hole assembly (330) includes capabilities for measuring, processing, and storing information, as well as communicating with the surface unit. The BHA (330) further includes drill collars (328) for performing various other measurement functions.

Sensors (S) are located about the wellsite to collect data, preferably in real time, concerning the operation of the wellsite, as well as conditions at the wellsite. The sensors (S) of FIG. 3 may be the same as the sensors of FIGS. 1A-D. The sensors of FIG. 3 may also have features or capabilities, of monitors, such as cameras (not shown), to provide pictures of the operation. Surface sensors or gauges (S) may be deployed about the surface systems to provide information about the surface unit, such as standpipe pressure, hookload, depth, surface torque, rotary rpm, among others. Downhole sensors or gauges (S) are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the various parts of the drilling system and/or the surface control unit.

The drilling system (302) is operatively connected to the surface unit (304) for communication therewith. The BHA (330) is provided with a communication subassembly (352) that communicates with the surface unit. The communication subassembly (352) is adapted to send signals to and receive signals from the surface using mud pulse telemetry. The communication subassembly may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Figure 4:
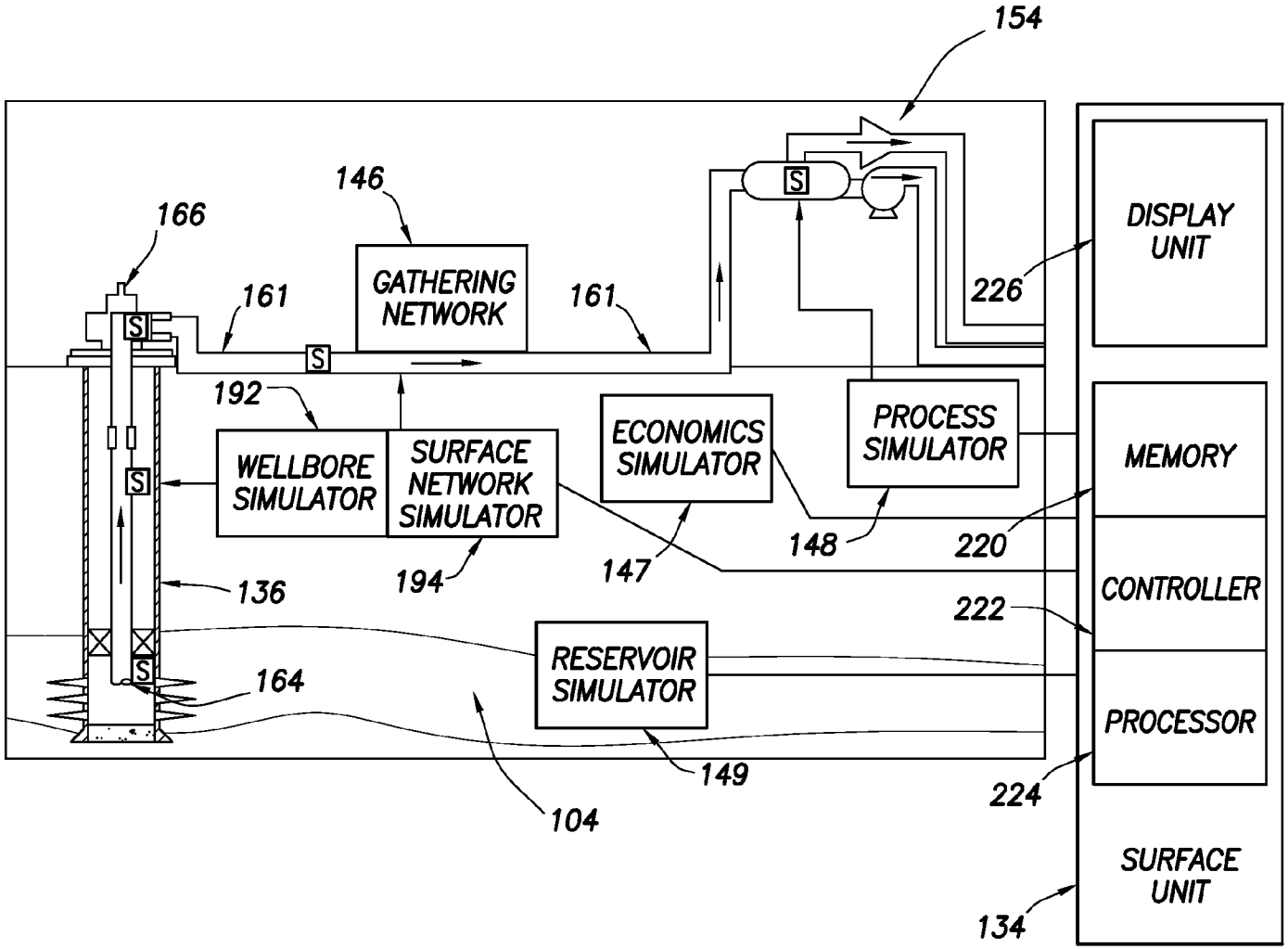
FIG. 4 shows a schematic diagram of a simulation management framework for integrated oilfield modeling.

FIG. 4 shows a schematic view of a portion of the oilfield (100) of FIGS. 1A-1D, depicting the wellsite and gathering network (146) in detail. The wellsite of FIG. 4 has a wellbore (136) extending into the earth therebelow. As shown, the wellbore (136) has already been drilled, completed, and prepared for production from reservoir (104). Wellbore production equipment (164) extends from a wellhead (166) of wellsite and to the reservoir (104) to draw fluid to the surface.

The wellsite is operatively connected to the gathering network (146) via a transport line (161). Fluid flows from the reservoir (104), through the wellbore (136), and onto the gathering network (146). The fluid then flows from the gathering network (146) to the process facilities (154).

As further shown in FIG. 4, sensors (S) are located about the oilfield to monitor various parameters during oilfield operations. The sensors (S) may measure, for example, pressure, temperature, flow rate, composition, and other parameters of the reservoir, wellbore, gathering network, process facilities and other portions of the oilfield operation. These sensors (S) are operatively connected to a surface unit (134) for collecting data therefrom.

One or more surface units (e.g., surface unit (134)) may be located at the oilfield, or linked remotely thereto. The surface unit (134) may be a single unit, or a complex network of units used to perform the necessary data management functions throughout the oilfield. The surface unit (134) may be a manual or automatic system. The surface unit (134) may be operated and/or adjusted by a user. The surface unit (134) is adapted to receive and store data. The surface unit (134) may also be equipped to communicate with various oilfield equipment. The surface unit (134) may then send command signals to the oilfield in response to data received.

The surface unit (134) has computer facilities, such as memory (220), controller (222), processor (224), and display unit (226), for managing the data. The data is collected in memory (220), and processed by the processor (224) for analysis. Data may be collected from the oilfield sensors (S) and/or by other sources. For example, oilfield data may be supplemented by historical data collected from other operations, or user inputs.

The analyzed data may then be used to make decisions. A transceiver (not shown) may be provided to allow communications between the surface unit (134) and the oilfield. The controller (222) may be used to actuate mechanisms at the oilfield via the transceiver and based on these decisions. In this manner, the oilfield may be selectively adjusted based on the data collected. These adjustments may be made automatically based on computer protocol and/or manually by an operator. In some cases, well plans are adjusted to select optimum operating conditions, or to avoid problems.

To facilitate the processing and analysis of data, simulators are typically used by the processor to process the data. Specific simulators are often used in connection with specific oilfield operations, such as reservoir or wellbore production. Data fed into the simulator(s) may be historical data, real time data or combinations thereof. Simulation through one or more of the simulators may be repeated, or adjusted based on the data received.

As shown, the oilfield operation is provided with wellsite and non-wellsite simulators. The wellsite simulators may include a reservoir simulator (149), a wellbore simulator (192), and a surface network simulator (194). The reservoir simulator (149) solves for petroleum flow through the reservoir rock and into the wellbores. The wellbore simulator (192) and surface network simulator (194) solves for petroleum flow through the wellbore and the surface gathering network (146) of pipelines. As shown, some of the simulators may be separate or combined, depending on the available systems.

The non-wellsite simulators may include process and economics simulators. The processing unit has a process simulator (148). The process simulator (148) models the processing plant (e.g., the process facility (154)) where the petroleum is separated into its constituent components (e.g., methane, ethane, propane, etc.) and prepared for sales. The oilfield is provided with an economics simulator (147). The economics simulator (147) models the costs of part or all of the oilfield. Various combinations of these and other oilfield simulators may be provided.

Each simulation domain incorporates constraints, which must be captured in the asset model. No single simulator is capable of accurately capturing all these constraints. The integrated asset modeling process takes a holistic approach to simulation by integrating and reconciling all aforementioned simulation domains. The ability to transfer constraints between simulators is an important aspect of an integrated system. This functionality is enabled by a simulation management framework.

Figure 5:
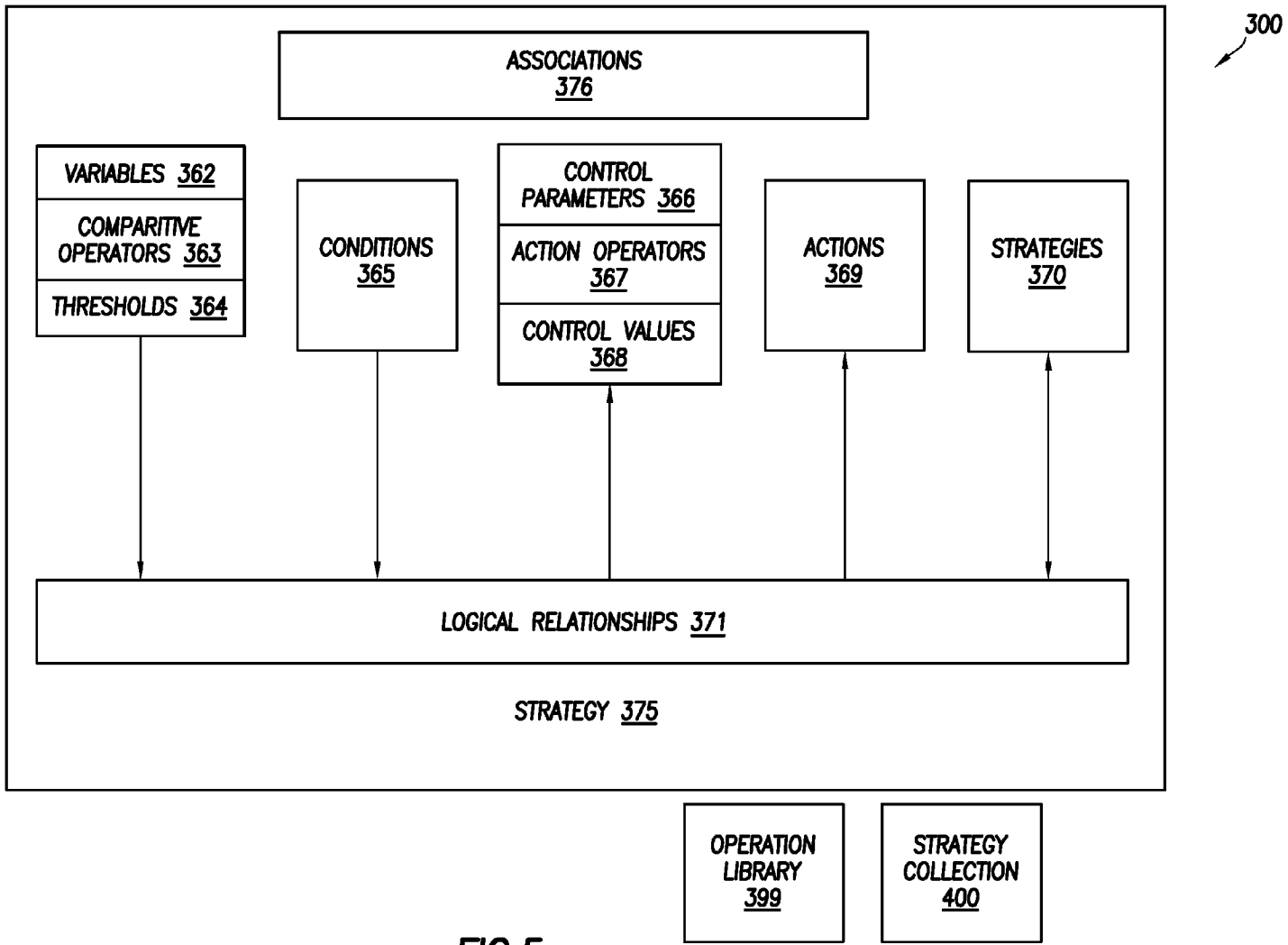
FIG. 5 shows a schematic diagram of a simulation management framework for integrated oilfield modeling.

FIG. 5 show a schematic diagram of a simulation management framework (300) for integrated oilfield modeling. Here, simulation management instructions are defined within the simulation management framework (300) as strategies, such as the strategy (375) or any other strategy contained in a strategy collection (400). The simulation management framework (300) also includes an operation library (399), which contains variables, control parameters, operators, conditions, actions, and/or other operation library elements. A strategy in the simulation management framework (300) is composed with various operation library elements. In the example shown in FIG. 5, the strategy (375) includes operation library elements selected from the operation library (399), such as variables (362), comparative operators (363), conditions (365), control parameters (366), action operators (367), actions (369), strategies (370), associations (376), and logical relationships (371), and the like.

The variables (362) and the control parameters (366) represent various entities modeled by the simulators, as described in FIG. 4 above. The variables (362) may be published into the simulation management framework (300) by the simulators during simulation. The comparative operators (363) may include numerical and/or logical comparisons such as EQUAL TO, GREATER THAN, LESS THAN, LESS THAN OR EQUAL, GREATER THAN OR EQUAL, and/or any other suitable operators. The comparative operators (363) may be selected to compare the variable (362) to a threshold (364). Each of the thresholds (364) may be a value or another variable of the simulators. The value may be a numerical value, a logical value, or state information. The conditions (365) may include logical evaluations such as the applying comparative operators (363) to the variables (362) with respect to thresholds (364), or any other suitable logical conditions that may arise during the simulation using the simulators described in reference to FIG. 4 above. The action operators (367) may include SET, MULTIPLY, INCREMENT, and/or any other suitable actions. The actions (369) may include applying the action operators (367) to the control parameters (366) or any other suitable actions the may be applied during the simulation using the simulators described in reference to FIG. 2 above. The control parameters (366) include variables (e.g., input variables) of the simulators. Some of the action operators (367) may operate in conjunction with control values (368). The control values (368) may be a value or another variable of the simulators. The value may be a numerical value, a logical value, or state information. The strategy (375) also includes associations (376) which associate some or all of the other operation library elements of the strategies (370) to at least one respective simulator and/or oilfield entity modeled by the simulators.

The logical relationships (371) may be composed with logical operators such as AND, OR, NOT, or any other suitable logical operators. The conditions (365) and actions (369) of the simulators and be combined using the logical relationships (371) to form simulation management instructions of a strategy (375). For example, the actions (369) may be executed based on the conditions (365) in view of the logical relationships (371). In one example, one of the actions (369) may be executed based on a corresponding condition of the conditions (365) being met. In another example, another one of the actions (369) may be executed based on another corresponding condition of the conditions (365) being not met. In still another example, another of the actions (369) may be executed based on a first corresponding condition being met OR a second corresponding condition not being met. It will be appreciated by one skilled in the art that the logical relationship may be based on any combination of the logical operators.

The strategy (375) may be developed hierarchically within the simulation management framework (300). In one example, the strategy (375) may be developed using first level elements selected from the operation library (399), such as the variables (362) and the action operators (367). In another example, the strategy (375) may be developed using second level elements selected from the operation library (399), such as the conditions (365) and the actions (369). In still another example, the strategy (375) may be developed using other developed or pre-developed strategies selected from the strategy collection (400), such as the strategies (370).

Figure 6B:
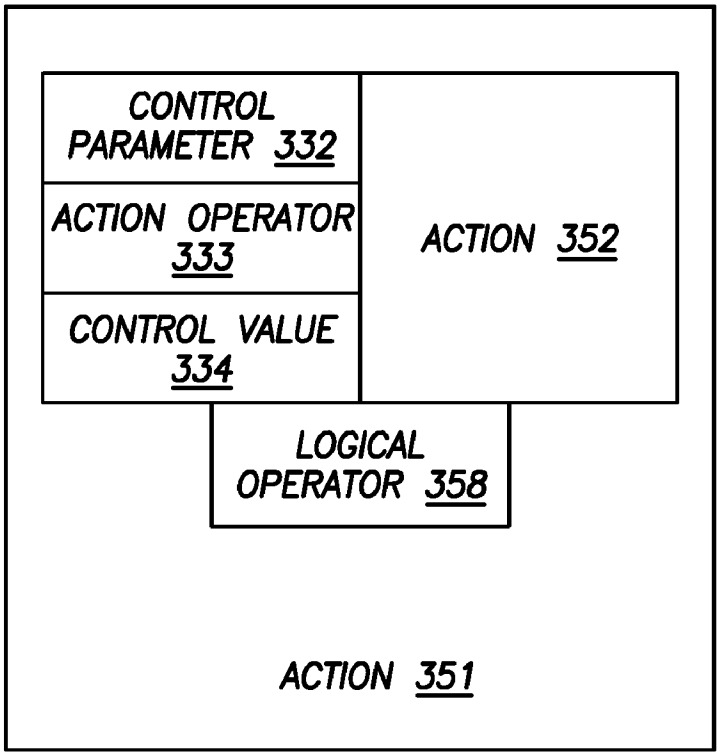
FIG. 6B shows a schematic diagram of defining an action.
Figure 6A:
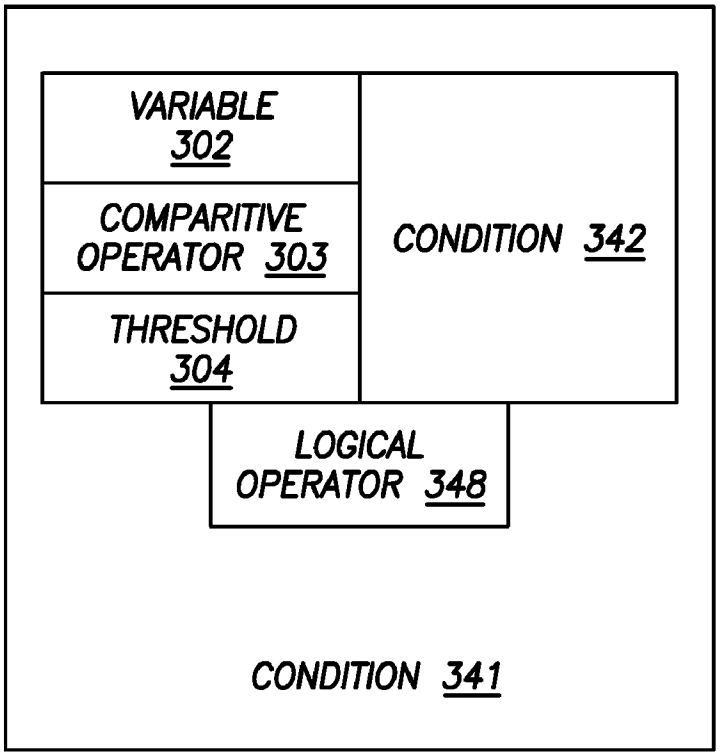
FIG. 6A shows a schematic diagram of defining a condition.

FIG. 6A shows a schematic diagram of defining a condition. Here, the condition (341) is shown to be composed hierarchically of a logical operator (348) applied to a pre-composed condition (342) and another condition composed in place, which includes applying the comparative operator (303) to a variable (302) with respect to a threshold (304). Some or all of the logical operator (348), the pre-composed condition (342), the comparative operator (303), the variable (302), and threshold (304) may be selected from the operation library (399) described above FIG. 6B shows a schematic diagram of defining an action. Here, the action (352) is shown to be composed hierarchically of a logical operator (358) applied to a pre-composed action (352) and another action composed in place, which includes applying the action operator (333) to a control parameter (332) optionally in conjunction with a control value (334). Some or all of the logical operator (358), the pre-composed action (352), the action operator (333), the control parameter (332), and the control value (334) may be selected from the operation library (399) described above.

Figure 6C:
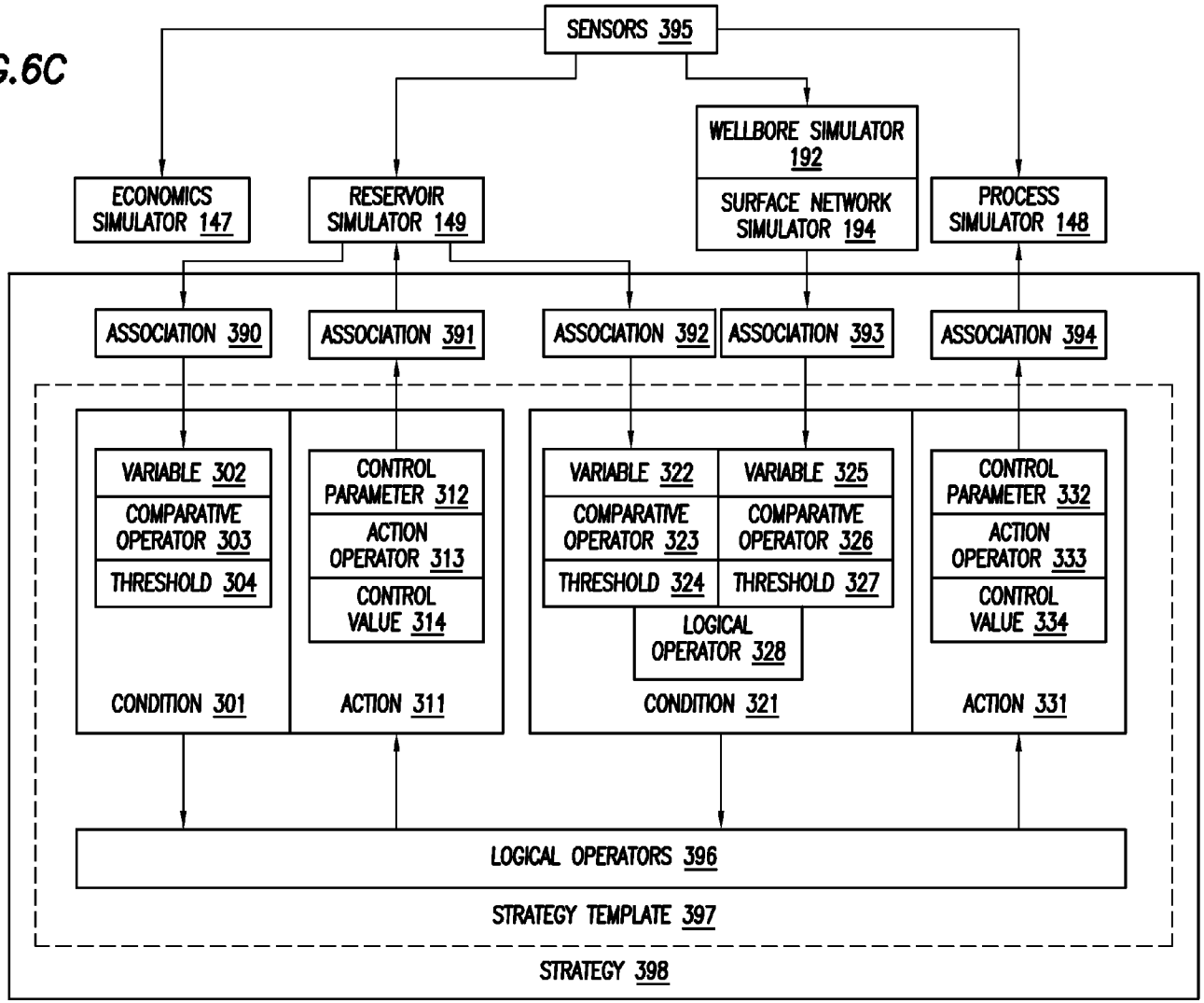
FIG. 6C shows a schematic diagram of developing a strategy.

FIG. 6C shows a schematic diagram of developing a strategy. Here, the strategy (398) is developed using a strategy template (397). A strategy template (397) is a generic strategy with no specific associations with the simulators and no specific logical relationships among the conditions and actions. In some examples, strategy templates (e.g., strategy template (397) may be included in the operation library (399) or the strategy collection (400) shown in FIG. 5. As shown in FIG. 4C, the strategy template (397) includes logical operators (396), conditions (301) and (321), and actions (311) and (331). The strategy (398) may be developed from the strategy template (397) by associating the variables (e.g., variable (302), variable (322), and/or variable (325)), control parameters (e.g., control parameter (312) and/or variable (332)), conditions (e.g., conditions (301) and variable (321)), and/or actions (e.g., actions (311) and/or actions (331)) of the strategy template (397) with corresponding simulators and by defining the logical relationship using the generic logical operators.

For example, the variable (302) of the condition (301) is associated by association (390) with the reservoir simulator (149), the control parameter (312) of the action (311) is associated by association (391) with the reservoir simulator (149), the variable (322) of the condition (321) is associated by association (392) with the reservoir simulator (149), the variable (325) of the condition (321) is associated by association (393) with the surface network simulator (194), and the control parameter (332) of the action (331) is associated by association (394) with the process simulator (148). In addition, the logical relationships are defined such that the action (311) is executed based on the condition (301) being met and the action (331) is executed based on the condition (321) being met.

Specifically, the strategy (398) may implement two simulation management instructions (not shown). The first simulation management instruction is based on the condition (301) and the action (311). The second simulation management instruction is based on the condition (321) and the action (331). In one example, the reservoir simulator (149) models the "well ID XXX" (e.g., wellhead (166), wellbore (136), and wellbore production equipment (164) in FIG. 2) and the first simulation management instruction may execute as the following:

IF "Gas-Oil Ratio" (i.e., variable (302)) of "well ID XXX" (i.e., association (391)) is "GREATER THAN" "1.5 MSCF/st" (i.e., threshold (304)), THEN "SETs" (i.e., action operator (313)) "Surface flow rate target" (i.e., control parameter (312)) of "well ID XXX" (i.e., association (390)) as "200,000 MMSC" (i.e., control value (314)).

In another example, the reservoir simulator (149) models the "well ID XXX" and the first simulation management instruction may execute as the following:

IF "Well status" (i.e., variable (302)) of "well ID XXX" (i.e., association (391)) is "EQUAL" to "Open to flow" (i.e., threshold (304)), THEN "SETs" (i.e., action operator (313)) "Surface flow rate target" (i.e., control parameter (312)) of "well ID XXX" (i.e., association (390)) as "200,000 MMSC" (i.e., control value (314)).

In yet another example, the reservoir simulator (149) models the "well ID XXX", the surface network simulator (194) models "Gather network with locations A and B" (e.g., gathering network (146)), the process simulator (148) models "Plant ID YYY including Compressor C" (e.g., process facility (154 in FIG. 2)), and the second simulation management instruction may execute as the following:

IF "Well status" (i.e., variable (302)) of "well ID XXX" (i.e., association (391)) is "EQUAL" to "Open to flow" (i.e., threshold (304)), AND (i.e., logical operator (328)) "Gas rate" (i.e., variable (325)) of "Gather network location A" (i.e., association (393)) is "GREATER THAN" "Gas rate" (i.e., threshold (327)) of "Gather network location B" (i.e., association (393)), THEN "SETS" (i.e., action operator (333)) "Compressor C" (i.e., control parameter (332)) of "Plant ID YYY" (i.e., association (393)) as 27,000 hp (ie., control value (334)).

Furthermore, continuing with FIG. 6C, a condition (e.g., conditions (301) and/or (321)) met or an action (e.g., action (311) and/or (331)) executed may be published into the simulation management framework as simulation events. The strategy (e.g., strategy (311)) may be developed at the beginning of simulation or interactively during simulation. The interactive development of strategies may be performed as desired or based on simulation events generated and/or analyzed. A strategy so developed may be included in the strategy collection (400 in FIG. 3) for reuse.

One skilled in the art will appreciate that while FIG. 6C shows an example of a schematic for developing a strategy, other configurations are possible. For example, with the following strategy:

Condition:

Var A operator Var B . . .

Action:

Var C operator Var D

Var A can come from reservoir simulator (149), Var B from economics simulator (147), Var C can come from process simulator (148) and Var D can come from process simulator (148). For example, threshold (327) can also come from process simulator (148)), control value (334) can also come from surface network simulator (194).

In addition, sensors (395) may be positioned about the oilfield as described in reference to FIG. 2 above. The simulator (e.g., reservoir simulator (149), process simulator (148), economics simulator (147), wellbore simulator (192), and surface network simulator (194)) may receive input data from the sensors (395) for modeling the real-time oilfield events during simulation.

Figure 7:
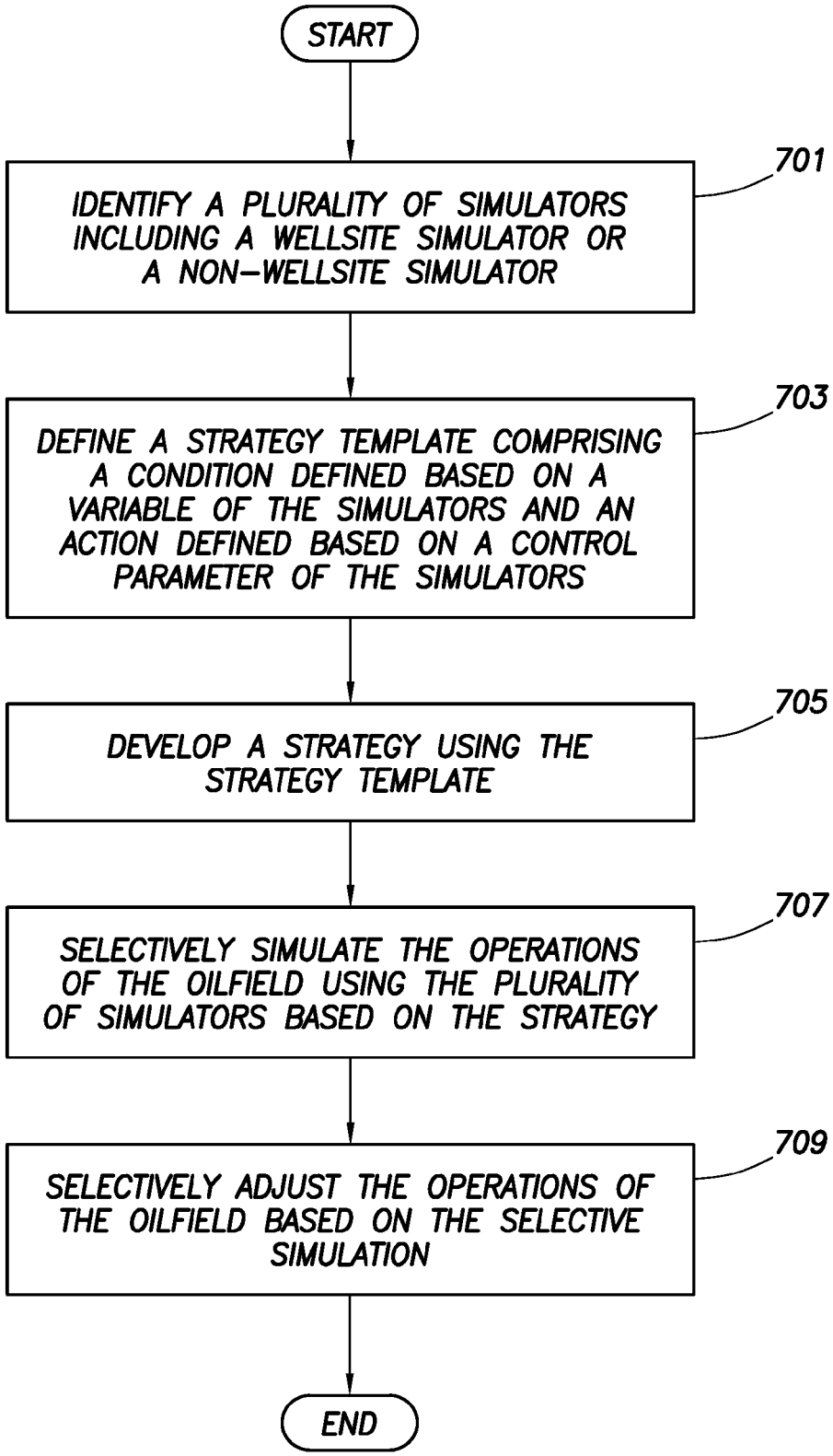
FIG. 7 shows a flow chart of a method for integrated oilfield modeling.

FIG. 7 shows a flow chart of method for integrated oilfield modeling. The method may be practiced, for example, using at least the system as shown in FIGS. 4 and 6C above. Initially, one or more simulators are identified which include both wellsite simulators and non-wellsite simulators, such as the economic simulator (147), the reservoir simulator (149), the wellbore simulator (192), the surface network simulator (194), and/or the process simulator (148) (Step 701). A strategy template (e.g., the strategy template (397)) is then defined, which may include a condition (e.g., the condition (301) or (321)) defined based on a variable (e.g., the variable (302), (322), and/or (325)) of the simulators and an action (e.g., the actions (311) and/or (331)) defined based on a control parameter (e.g., the control parameter (312) and/or (332)) of the simulators (Step 703). A strategy (e.g., the strategy (398)) is then developed using the strategy template for managing the plurality of simulators during simulation (Step 705). The oilfield operations are selectively simulated based on the strategy using the plurality of simulators (Step 707). Accordingly, the oilfield operations are selectively adjusted based on the selective simulation (Step 709).

It will be understood from the foregoing description that various modifications and changes may be made in the preferred and alternative embodiments of the present invention without departing from its true spirit. For example, the operation library, the strategy template, and/or the simulation management framework may include subset or superset of the examples described, the method may be performed in a different sequence, the components provided may be integrated or separate, the devices included herein may be manually and/or automatically activated to perform the desired operation. The activation (e.g., the interactive development of strategies) may be performed as desired and/or based on data generated, conditions detected, and/or analysis of results from downhole operations.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of performing production operations of an oilfield having at least one process facility and at least one wellsite operatively connected thereto, each at least one wellsite having a wellbore penetrating a subterranean formation for extracting fluid from an underground reservoir therein, the method comprising:

identifying a plurality of simulators from a group consisting of a wellsite simulator for modeling at least a portion of the wellsite of the oilfield and a non-wellsite simulator for modeling at least a portion of a non-wellsite portion of the oilfield;

defining a first condition based on comparing a value of a first variable of the plurality of simulators to a threshold using a comparative operator, the threshold comprising at least one selected from a group consisting of a predetermined value and a second variable of the plurality of simulators;

defining a first action based on applying an action operator to a control parameter of the plurality of simulators;

defining a first strategy template comprising the first condition and the first action, wherein execution of the first action during simulation is determined based on the first condition in view of a logical relationship;

developing a first strategy for managing the plurality of simulators during simulation, wherein the first strategy is developed using the first strategy template by:

defining the logical relationship for determining the execution of the first action based on the first condition during simulation;

configuring the first condition by associating the first variable to a first simulator of the plurality of simulators and to a first entity of the oilfield, the value of the first variable being published by the first simulator during simulation of the first entity; and configuring the first action by associating the control parameter to a second simulator of the plurality of simulators and to a second entity of the oilfield, the second simulator performing simulation responsive to the control parameter of the second entity; and selectively simulating the operations of the oilfield using the plurality of simulators based on the first strategy.

2. The method of claim 1, wherein the comparative operator comprises at least one selected from a group consisting of EQUAL TO, GREATER THAN, LESS THAN, LESS THAN OR EQUAL, and GREATER THAN OR EQUAL.

3. The method of claim 1, wherein the action operator comprises at least one selected from a group consisting of SET, MULTIPLY, INCREMENT, and DECREMENT.

4. The method of claim 1, further comprising at least one selected from a group consisting of configuring a second condition to comprise the first condition and a logical operator applied to the first condition, configuring a second action to comprise the first action and the logical operator applied to the first action, and developing a second strategy to comprise the first strategy and the logical operator applied to the first strategy.

5. The method of claim 4, further comprising at least one selected from a group consisting of configuring the second condition to further comprise the logical operator applied to a third condition, configuring the second action to further comprise the logical operator applied to a third action, and developing the second strategy to further comprise the logical operator applied to a third strategy.

6. The method of claim 1, further comprising:

positioning a sensor about the oilfield, wherein the sensor measures a data parameter of the operations of the oilfield, and wherein at least one simulator of the plurality of simulators performs simulation responsive to the data parameter received from the sensor.

7. The method of claim 1, further comprising:

configuring a surface unit at the oilfield, wherein the surface unit implements an operation plan modeled by the plurality of simulators.

8. The method of claim 1 wherein the plurality of simulators comprise at least one selected from a group consisting of reservoir simulator, wellbore simulator, surface simulator, process simulator, and economics simulator.

9. The method of claim 1, further comprising:

presenting a simulation event representing the execution of the first action during simulation, wherein the simulation event comprises at least one selected from a group consisting of the first condition, the first action, and cumulative number of times of the execution of the first action.

10. The method of claim 9, further comprising:

developing a second strategy based on the simulation event during simulation.

11. The method of claim 1, further comprising:

developing the first strategy prior to simulation.

12. The method of claim 1, further comprising:

developing the first strategy interactively during simulation.

13. The method of claim 1, further comprising:

defining a strategy collection comprising a plurality of strategies, wherein the first strategy is selected from the strategy collection.

14. The method of claim 1, further comprising:

selectively adjusting the operations of the oilfield based on the selective simulation.

15. A non-transitory computer readable medium, embodying instructions executable by a computer to perform method steps for performing production of an oilfield having at least one process facilities and at least one wellsite operatively connected thereto, each at least one wellsite having a wellbore penetrating a subterranean formation for extracting fluid from an underground reservoir therein, the instructions comprising functionality to:

identify a plurality of simulators from a group consisting of a wellsite simulator for modeling at least a portion of the wellsite of the oilfield and a non-wellsite simulator for modeling at least a portion of a non-wellsite portion of the oilfield;

define a first condition based on comparing a value of a first variable of the plurality of simulators to a threshold using a comparative operator, the threshold comprising at least one selected from a group consisting of a pre-determined value and a second variable of the plurality of simulators;

define a first action based on applying an action operator to a control parameter of the plurality of simulators;

define a first strategy template comprising the first condition and the first action, wherein execution of the first action during simulation is determined based on the first condition in view of a logical relationship;

develop a first strategy for managing the plurality of simulators during simulation, wherein the first strategy is developed using the first strategy template by:

defining the logical relationship for determining the execution of the first action based on the first condition during simulation;

configuring the first condition by associating the first variable to a first simulator of the plurality of simulators and to a first entity of the oilfield, the value of the first variable being published by the first simulator during simulation of the first entity; and configuring the first action by associating the control parameter to a second simulator of the plurality of simulators and to a second entity of the oilfield, the second simulator performing simulation responsive to the control parameter of the second entity; and selectively simulate the operations of the oilfield using the plurality of simulators based on the first strategy.

16. The non-transitory computer readable medium of claim 15, wherein the comparative operator comprises at least one selected from a group consisting of EQUAL TO, GREATER THAN, LESS THAN, LESS THAN OR EQUAL, and GREATER THAN OR EQUAL.

17. The non-transitory computer readable medium of claim 15, wherein the action operator comprises at least one selected from a group consisting of SET, MULTIPLY, INCREMENT, and DECREMENT.

18. The non-transitory computer readable medium of claim 15, the instructions further comprising functionality to perform at least one selected from a group consisting of defining a second condition comprising the first condition and a logical operator applied to the first condition, the second condition being comprised in the first strategy template, defining a second action comprising the first action and the logical operator applied to the first action, the second action being comprised in the first strategy template, and developing a second strategy comprising the first strategy and the logical operator applied to the first strategy.

19. The non-transitory computer readable medium of claim 18, the instructions further comprising functionality to perform at least one selected from a group consisting of defining the second condition further comprising the logical operator applied to a third condition, defining the second action further comprising the logical operator applied to a third action, and developing the second strategy further comprising the logical operator applied to a third strategy.

20. The non-transitory computer readable medium of claim 15,the instructions further comprising functionality to:

position a sensor about the oilfield, wherein the sensor measures a data parameter of the operations of the oilfield, and wherein at least one simulator of the plurality of simulators performs simulation responsive to the data parameter received from the sensor.

21. An oilfield simulator for performing production of an oilfield having at least one process facilities and at least one wellsite operatively connected thereto, each at least one wellsite having a wellbore penetrating a subterranean formation for extracting fluid from an underground reservoir therein, comprising:

a plurality of simulators from a group consisting of a wellsite simulator for modeling at least a portion of the wellsite of the oilfield and a non-wellsite simulator for modeling at least a portion of a non-wellsite portion of the oilfield;

a strategy template comprising a first condition and a first action, wherein execution of the first action during simulation is determined based on the first condition in view of a logical relationship, wherein the first condition is defined based on comparing a value of a first variable of the plurality of simulators to a threshold using a comparative operator, the threshold comprising at least one selected from a group consisting of a pre-determined value and a second variable of the plurality of simulators; and wherein the first action is defined based on applying an action operator to a control parameter of the plurality of simulators; and a surface unit at the oilfield, wherein the surface unit develops a first strategy for managing the plurality of simulators during simulation, the first strategy being developed using the first strategy template by:

defining the logical relationship for determining the execution of the first action based on the first condition during simulation:

associating the first variable to a first simulator of the plurality of simulators and to a first entity of the oilfield, the value of the first variable being published by the first simulator during simulation of the first entity; and associating the control parameter to a second simulator of the plurality of simulators and to a second entity of the oilfield, the second simulator performing simulation responsive to the control parameter of the second entity, wherein the operations of the oilfield are selectively simulated based on the first strategy using the plurality of simulators.

22. The oilfield simulator of claim 21, wherein the comparative operator comprises at least one selected from a group consisting of EQUAL TO, GREATER THAN, LESS THAN, LESS THAN OR EQUAL, and GREATER THAN OR EQUAL.

23. The oilfield simulator of claim 21, wherein the action operator comprises at least one selected from a group consisting of SET, MULTIPLY, INCREMENT, and DECREMENT.

24. The oilfield simulator of claim 21, further comprising at least one selected from a group consisting of a second condition comprising the first condition and a logical operator applied to the first condition, the second condition being comprised in an operation library, a second action comprising the first action and the logical operator applied to the first action, the second action being comprised in the operation library, and a second strategy comprising the first strategy and the logical operator applied to the first strategy.

25. The oilfield simulator of claim 24, further comprising at least one selected from a group consisting of the second condition further comprising the logical operator applied to a third condition, the second action further comprising the logical operator applied to a third action, and the second strategy further comprising the logical operator applied to a third strategy.

26. The oilfield simulator of claim 21, further comprising:

a sensor positioned about the oilfield, wherein the sensor measures a data parameter of the operations of the oilfield, and wherein at least one simulator of the plurality of simulators performs simulation responsive to the data parameter received from the sensor.

27. The oilfield simulator of claim 21, wherein the surface unit implements an operation plan modeled by the plurality of simulators.

28. A surface unit for performing production of an oilfield having at least one process facilities and at least one wellsite operatively connected thereto, each at least one wellsite having a wellbore penetrating a subterranean formation for extracting fluid from an underground reservoir therein, the surface unit comprising:

a processor; and memory storing instructions, when executed by the processor, comprising functionality to:

identify a plurality of simulators from a group consisting of a wellsite simulator for modeling at least a portion of the wellsite of the oilfield and a non-wellsite simulator for modeling at least a portion of a non-wellsite portion of the oilfield;

define a first condition based on comparing a value of a first variable of the plurality of simulators to threshold using a comparative operator, the threshold comprising at least one selected from a group consisting of a pre-determined value and a second variable of the plurality of simulators;

define a first action based on applying an action operator to a control parameter of the plurality of simulators;

define a first strategy template comprising the first condition and the first action, wherein execution of the first action during simulation is determined based on the first condition in view of a logical relationship;

develop a first strategy for managing the plurality of simulators during simulation, wherein the first strategy is developed using the first strategy template by:

defining the logical relationship for determining the execution of the first action based on the first condition during simulation;

configuring the first condition by associating the first variable to a first simulator of the plurality of simulators and to a first entity of the oilfield, the value of the first variable being published by the first simulator during simulation of the first entity; and configuring the first action by associating the control parameter to a second simulator of the plurality of simulators and to a second entity of the oilfield, the second simulator performing simulation responsive to the control parameter of the second entity; and selectively simulate the operations of the oilfield using the plurality of simulators based on the first strategy.

* * * * *